US009664488B2

(12) United States Patent
Pruett et al.

(10) Patent No.: US 9,664,488 B2
(45) Date of Patent: May 30, 2017

(54) AMMUNITION RELOADING SYSTEMS AND METHODS

(71) Applicant: AMMOBOT, LLC, Blytheville, AR (US)

(72) Inventors: Jason D. Pruett, Blytheville, AR (US); Jason T. Carter, Manila, AR (US)

(73) Assignee: AMMOBOT, LLC, Blytheville, AK (US)

( * ) Notice: Subject to any disclaimer, the term of this patent is extended or adjusted under 35 U.S.C. 154(b) by 0 days.

(21) Appl. No.: 14/850,581

(22) Filed: Sep. 10, 2015

(65) Prior Publication Data

US 2016/0084624 A1 Mar. 24, 2016

Related U.S. Application Data

(60) Provisional application No. 62/053,475, filed on Sep. 22, 2014.

(51) Int. Cl.
*F42B 33/00* (2006.01)

(52) U.S. Cl.
CPC ..... *F42B 33/001* (2013.01); *F42B 33/004* (2013.01)

(58) Field of Classification Search
CPC ..... F42B 33/00; F42B 33/001; F42B 33/002; F42B 33/004; F42B 33/0278
USPC ..... 86/10, 12, 23–29, 45
See application file for complete search history.

(56) References Cited

U.S. PATENT DOCUMENTS

| | | | | |
|---|---|---|---|---|
| 4,852,451 | A * | 8/1989 | Rogers | F42B 33/0285 73/149 |
| 7,743,692 | B2 * | 6/2010 | Jackson | F42B 33/10 86/23 |
| 9,151,583 | B1 * | 10/2015 | Stark | F42B 33/004 |
| 2006/0180011 | A1 * | 8/2006 | Benn | F42B 33/02 86/27 |
| 2006/0180012 | A1 * | 8/2006 | Benn | F42B 33/02 86/28 |
| 2009/0013859 | A1 * | 1/2009 | de Almeida | F42B 33/00 86/24 |

OTHER PUBLICATIONS

Youtube; author jmorrismetal, "Computer controlled Dillon 1050"; https://www.youtube.com/watch?v=MrFhnDQ-eUU Mar. 23, 2014.*

Youtube; author atvraceyfz, "Dillon 1050 auto with PLC", https://www.youtube.com/watch?v=N_0n_1ha9w Apr. 23, 2013.*

(Continued)

*Primary Examiner* — John D Cooper
(74) *Attorney, Agent, or Firm* — Workman Nydegger

(57) ABSTRACT

An automatic ammunition reloading system includes an actuation assembly in communication with a control system. The actuation assembly is joined to a reloading press by attaching to a control lever of the ammunition press so as to put the reloading press in operative relation with the actuation assembly. The control system receives input from a control lever position sensor to sense an extremity position of the control lever and to determine an actuation distance of the control lever for a full stroke of the reloading press. The control system controls operation of the actuation assembly so as to oscillate the control lever through the actuation distance.

16 Claims, 12 Drawing Sheets

(56) References Cited

OTHER PUBLICATIONS

NPL, http://www.forchtfirearms.com/images2/IMG_0929.JPG, Apr. 1, 2013.*
NPL, http://web.archive.org/web/20141114170232/http://reloaders.com/dillon-super-1050-auto-drive; Nov. 14, 2014.*
NPL, http://web.archive.org/web/20130329022723/http://www.forchtfirearms.com/dillondoc.html; Mar. 29, 2013.*

* cited by examiner

AMMUNITION RELOADING SYSTEMS AND METHODS

CROSS-REFERENCE TO RELATED APPLICATIONS

This application is a non-provisional application claiming priority to and the benefit of U.S. Patent Application Ser. No. 62/053,475, filed on Sep. 22, 2014 and entitled "AMMUNITION RELOADING SYSTEMS AND METHODS," the entirety of which application is expressly incorporated herein by this reference in its entirety.

BACKGROUND

The present disclosure relates generally to ammunition reloading systems configured to provide automated reloading of ammunition.

Ammunition reloading, also referred to as handloading, is the process of loading firearm cartridges or shotgun shells by assembling the individual components rather than purchasing pre-assembled or factory-loaded ammunition. Ammunition reloading can make use of entirely newly manufactured components or used components. For instance, typical reloading processes utilize previously fired cartridge cases. Ammunition reloading can be done for hobby, economic savings, increased control over accuracy/performance of ammunition, and to provide ammunition in periods of commercial ammunition shortages.

Typical ammunition components used in a reloading process include bullets, powder, cases, and primers. The reloading process typically follows the steps of resizing the case using one or more dies, seating a new primer in the used case, adding an amount of powder, seating a bullet in the case, and crimping the bullet in place if necessary.

Ammunition components are typically prepared and assembled using an ammunition reloading press. Available presses include single-stage presses, which perform one step on one case at a time, turret presses, which permit mounting of all the dies for one cartridge simultaneously with die switching performed by rotating the turret, and progressive presses, where each pull of the lever performs a single step on all cases in the press at once. Progressive presses can be fitted with all dies needed for a desired cartridge, along with a powder measure and primer feed, and can result in one finished round per pull during operation.

BRIEF SUMMARY

In some embodiments, an ammunition reloading system includes an actuator assembly and a control system. In other embodiments, an ammunition reloading system includes an actuator assembly, a control system, and a reloading press that is joined to the actuator assembly and is in operative relation with the actuator assembly. For example, the actuator assembly may be joined (e.g., detachably) to a control segment of the reloading press, such as a handle, arm, lever, shaft, axle, piston, crank, or other actuation means configured to actuate the reloading press upon the transmission of force or movement (e.g. rotational, torsional, lateral, normal/end-long) to the control segment of the reloading press.

Certain embodiments are directed to an ammunition reloading system including a motor; a frame configured to be attachable to an ammunition reloading press; a power transmission assembly joined to the motor and to the frame, the power transmission assembly including a coupling element configured to couple with a control lever of the ammunition reloading press, the power transmission assembly being configured to transmit power from the motor to the control lever so as to actuate the ammunition reloading press; and a control system in operative communication with the motor and with one or more sensors, the control system being configured to receive input from the one or more sensors, the input including a first extremity position of the control lever, and to send one or more operational instructions to the motor based on the received input.

Certain embodiments are directed to an ammunition reloading system including an ammunition reloading press including a control lever; a motor; a frame configured to be attachable to the ammunition reloading press; a power transmission assembly joined to the motor and to the frame, the power transmission assembly including a coupling element configured to couple with the control lever, the power transmission assembly being configured to transmit power from the motor to the control lever so as to actuate the ammunition reloading press; and a control system in operative communication with the motor and with one or more sensors, the control system being configured to receive input from the one or more sensors, the input including a first extremity position of the control lever, and to send one or more operational instructions to the motor based on the received input.

Certain embodiments are directed to a method of automated reloading of ammunition, including: positioning a control lever of an ammunition reloading press at a first extremity position, the ammunition reloading press being coupled to an ammunition reloading system including a motor, a frame attached to the ammunition reloading press, a power transmission assembly joined to the motor and to the frame, the power transmission assembly including a coupling element configured to couple with the control lever, the power transmission assembly being configured to transmit power from the motor to the control lever so as to actuate the ammunition reloading press, and a control system in operative communication with the motor and with one or more sensors, the control system being configured to receive input from the one or more sensors and to send one or more operational instructions to the motor based on the received input; actuating the control lever to move the control lever from the first extremity position to a second extremity position, the distance between the first extremity position and the second extremity position defining an actuation distance; and operating the ammunition reloading system to provide oscillatory actuation of the control lever through the actuation distance.

BRIEF DESCRIPTION OF THE DRAWINGS

To further clarify the above and other advantages and features of the present disclosure, a more particular description of the disclosure will be rendered by reference to specific embodiments thereof which are illustrated in the appended drawings. It is appreciated that these drawings depict only illustrated embodiments of the disclosure and are therefore not to be considered limiting of its scope. Embodiments of the disclosure will be described and explained with additional specificity and detail through the use of the accompanying drawings in which.

DETAILED DESCRIPTION

Figure 1:
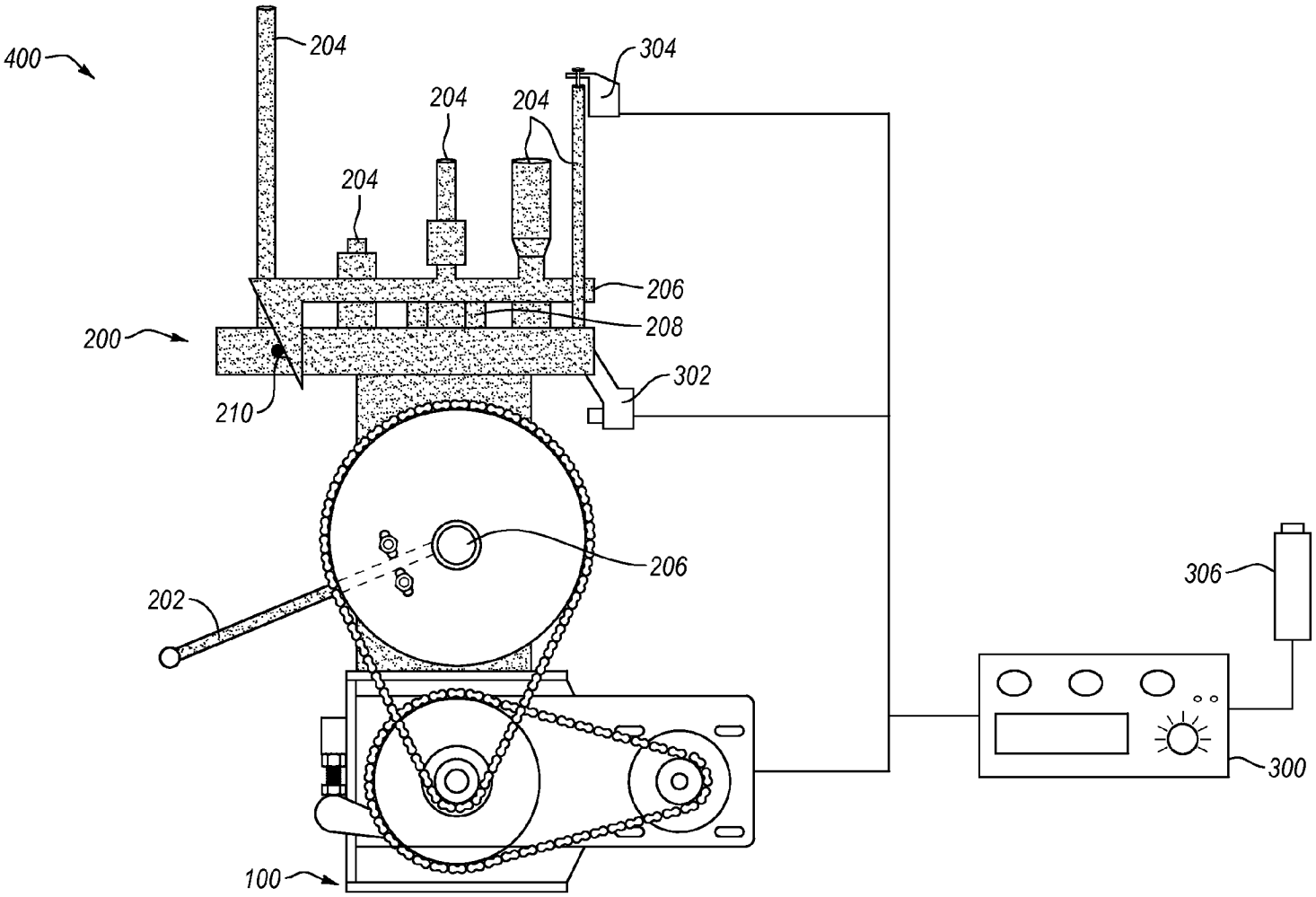
FIG. 1 illustrates an ammunition reloading system according to some embodiments of the present disclosure, which includes an actuator assembly.

FIG. 1 illustrates an embodiment of an ammunition reloading system 400 including a reloading press 200 coupled to an actuator assembly 100. The reloading press 200 can include a control lever 202. As shown, the actuator assembly 100 can be attached to the reloading press 200 such that the control lever 202 of the reloading press 200 is in operative relation to the actuator assembly 100. As described in more detail below, one or more components of the actuator assembly 100 may be configured to be attachable to, and be attached to, the control lever 202 so as to enable modulation of the control lever 202 through operation of the actuator assembly 100.

The reloading press 200 may be any type of press usable in a process of ammunition reloading. The reloading press 200 may be a progressive press capable of producing at least one round of ammunition per pull and/or per press cycle. In other embodiments, a reloading press may be a single press or a turret press. The reloading press 200 may be any press that is configured for one or more of the steps of positioning an ammunition case, reforming an ammunition case by pressing it within one or more dies, positioning a primer within an ammunition case, adding powder to an ammunition case, positioning or mounting a bullet onto a case, and sealing (e.g., crimping) a bullet in position on a case, for example. The reloading press 200 may include one or more reloading press components 204 (e.g., bins, tubes, etc.) configured to store, sort, and/or align cases, primers, powder, bullets, finished rounds, etc.

In some embodiments, the reloading press 200 is a progressive shotshell press. For example, the reloading press 200 may be configured to perform one or more of the steps of depriming a shell, reshaping a shell, priming a shell, loading a shell with powder, pressing a wad into a shell, loading shot into a shell, and crimping a shell.

The actuator assembly 100 can be configured to be in communication with a control system 300. In some embodiments, one or more sensors may be joined to the actuator assembly 100 and/or to the reloading press 200 and can be configured to be in communication with the control system 300. For example, a control lever position sensor 302 can be positioned on the reloading press 200. As described in further detail below, the control lever position sensor 302 (in communication with the control system 300) is configured to detect an extremity position of the control lever 202, thereby enabling the control system 300 to determine an actuation distance of the control lever 202 (e.g., the distance the control lever 202 must be moved to provide a full stroke of the reloading press 200) and/or a relative position of the control lever 202. The control system 300 can then transmit corresponding instructions and/or power to the actuator assembly 100 (e.g., to control/power a motor of the actuator assembly 100) to ensure a full stroke or cycle without the need of further calibration of the system by a user.

As another example, a reloading component sensor 304 (in communication with the control system) can be positioned on the reloading press 200. The reloading component sensor 304 can be configured to detect the level of bullets, powder, primers, cases, and/or other ammunition components in one or more of the reloading components 204. For example, a reloading component sensor 304 can be coupled with a primer bin/tube and configured to detect the absence of primers and to send a corresponding signal to the control system 300. Other embodiments may include one or more sensors configured to detect levels of other round components (e.g., bullets, cases), detect reloading press and/or actuator assembly malfunctions, detect other positions of the control lever, etc.

The sensors 302 and 304 can include optical sensors, magnetic sensors, mechanical sensors, or any other types of proximity sensors. For example, some embodiments include a primer sensor configured to detect the presence of a mis-sized and/or mischaracterized primer through coupling of the sensor with a pin that is sized and shaped to match appropriate primers during the reloading process. The sensor is triggered when the pin is displaced and/or when a predetermined force is applied to the pin. For example, the pin may be held in place within a die of the press (e.g., a decapping die), and positioned so that it is pressed away from the direction of die movement upon encountering an obstruction, upon encountering a primer that is sized too small for the pin to fit into, or upon encountering a type of primer that the pin has not been configured to fit into (e.g., a Berdan primer when the pin has been configured to fit into Boxer primers). In another example, a magnetic sensor (not presently shown) is disposed on one or more case tube(s) of the reloading press 200. The magnetic sensor is triggered, in such embodiments, upon coming into contact with a steel case and/or upon passage of a steel case through the case tube, for example.

As illustrated, the actuator assembly 100 and/or one or more sensors (e.g., 302 and 304) may be connected to the control system 300 using a hard-wired connection (e.g., serial, USB, thunderbolt, etc.). Additionally, or alternatively, the actuator assembly 100 and/or one or more sensors (e.g., 302 and 304) may be connected to the control system 300 using a short-range wireless protocol (e.g., WiFi, Bluetooth, NFC, etc.) or through a network (e.g., a Local Area Network ("LAN"), a Wide Area Network ("WAN"), or the Internet).

As described in further detail below, the control system 300 includes one or more user interfaces (such as the interfaces of FIGS. 7-10) through which a user is enabled to enter instructions to be sent to the actuator assembly 100 (e.g., to initiate operation, alter the rate of operation, or terminate operation). In some embodiments, the user interface also permits a user to view feedback or information received by the control system (e.g., control lever position, rate of operation, number of cycles or strokes accomplished in the current reloading process, level(s) of round components, etc.). The user interface may include, for example, one or more keyboards, touch screens, joysticks, trackballs, mouse controllers, monitors, speakers, printers, buttons, dials, sliders, light displays, and/or any other input or display components.

The control system 300 may control any one of, or any combination of, the steps of any of the processes described in this application. In some embodiments, the processes described herein may be performed automatically, or may be invoked by some form of manual intervention. For example, the control system 300 may include a start switch and/or an emergency kill switch, providing a user with the means to initiate and terminate operations at will. Additionally, or alternatively, the control system 300 may be configured to terminate operations upon detecting a malfunction (e.g., by receiving a malfunction signal from one or more sensors). The control system 300 can control operation of the actuator assembly 100 by selectively controlling power to the actuator assembly 100 (e.g., sending, restricting or otherwise modifying the flow of current and voltages being sent to the actuator assembly components) and/or by sending signals to the actuator assembly components that cause the actuator assembly to control the current and voltages being utilized at the actuator assembly 100.

The ammunition reloading system 400 can also include a hand-held switch 306. Hand-held switch 306 is in communication with control system 300 (e.g., through a hard-wired connection, or local wireless connection). Hand-held switch 306 is configured to send a signal and/or instruction to the control system 300 upon being actuated by a user. For example, the hand-held switch 306 is configured, in one embodiment, as an emergency kill switch, allowing a user to observe automated operation of the reloading press 200 from a safe and/or comfortable distance while maintaining the ability to quickly terminate operation of the actuator assembly 100 upon observing a malfunction or otherwise desiring termination of operations. In other embodiments, the hand-held switch 306 includes one or more additional or alternative controls, such as an initiation switch, speed adjustment, etc.

Figure 2:
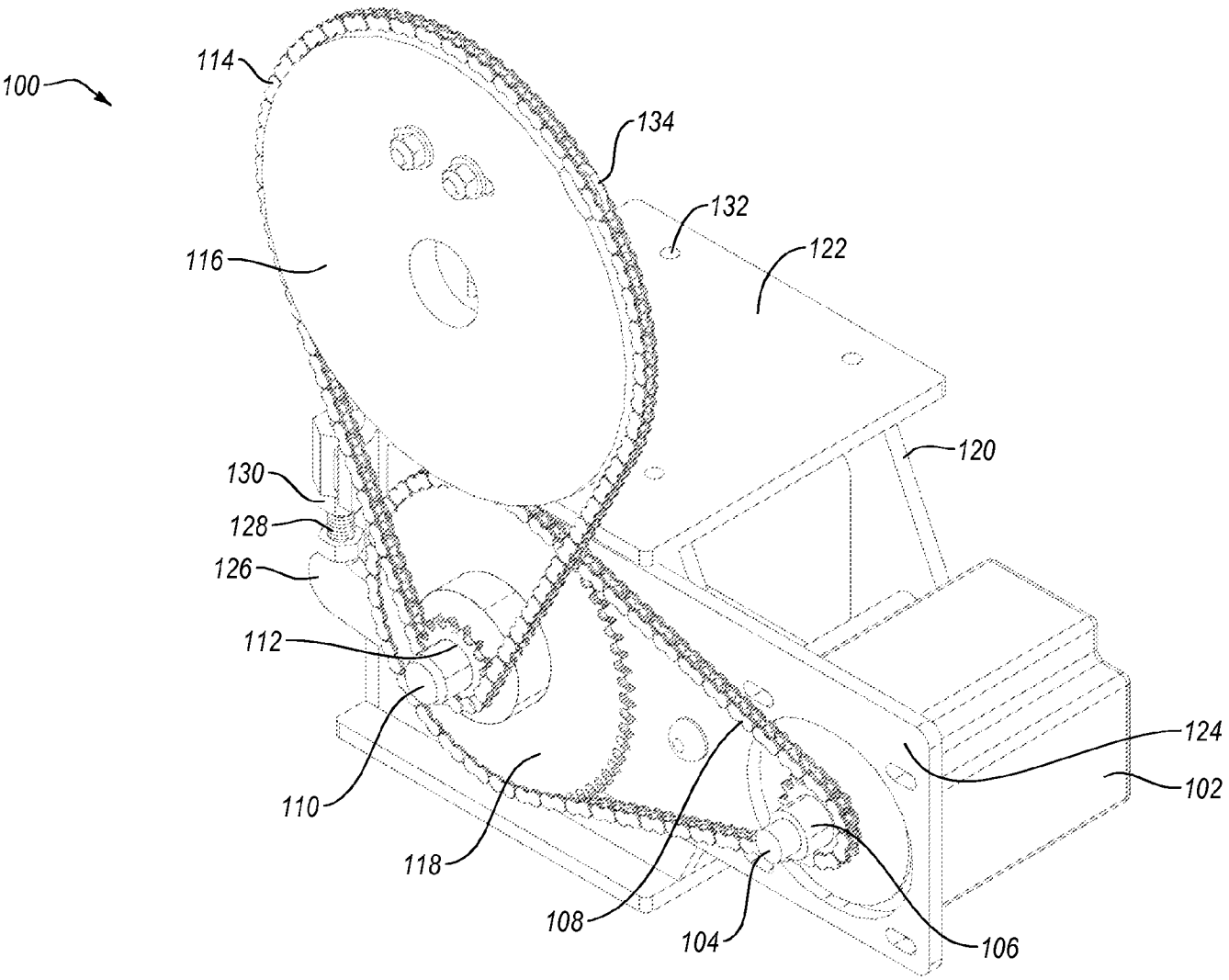
FIG. 2 illustrates a top perspective view of the actuator assembly.
Figure 3:
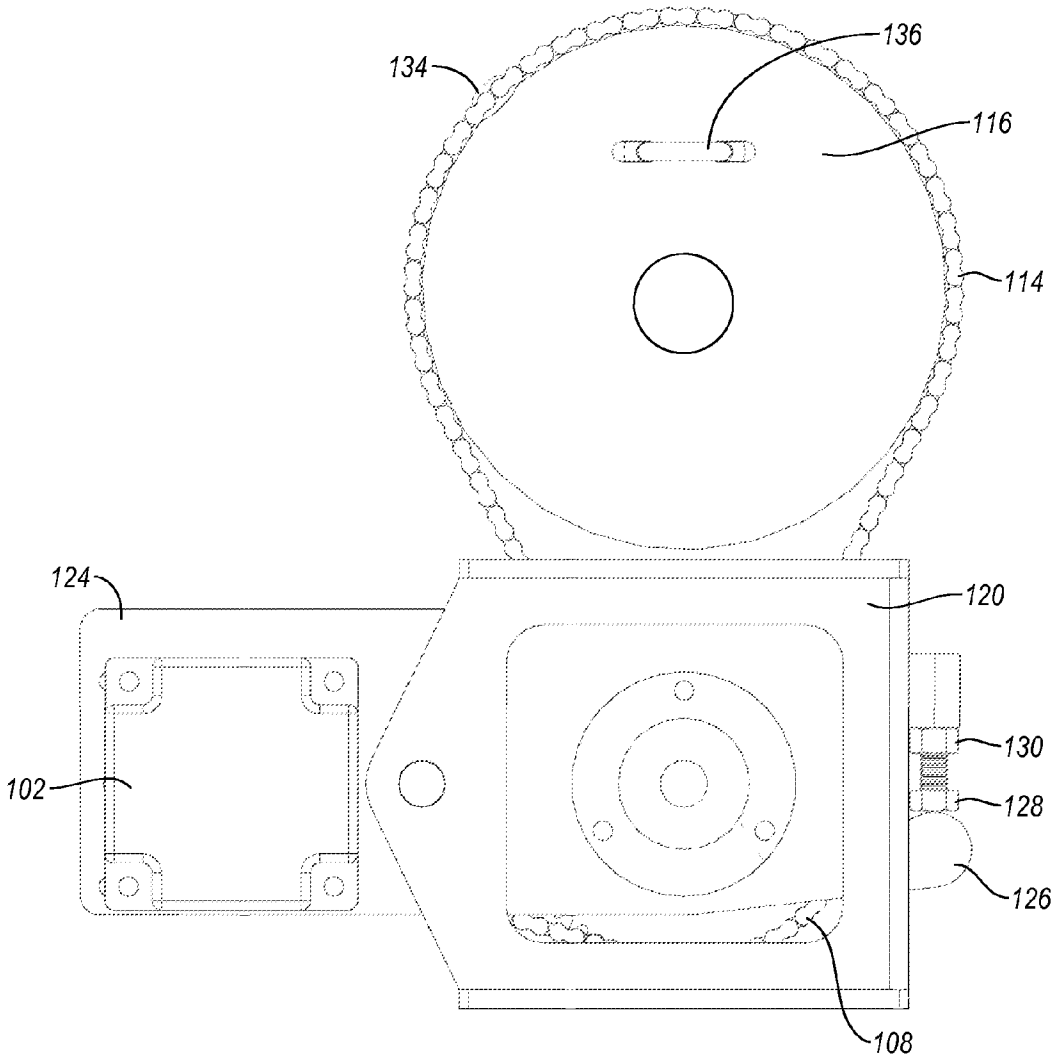
FIG. 3 illustrates a side view of the actuator assembly.

FIGS. 2 and 3 illustrate an embodiment of an actuator assembly 100 including a motor 102, a primary shaft 104, a primary sprocket 106, a primary chain 108, a secondary sprocket 118, a secondary shaft 110, a tertiary sprocket 112, a secondary chain 114, and a drive plate 116. In the illustrated embodiment, the primary shaft 104, primary sprocket 106, primary chain 108, secondary sprocket 118, secondary shaft 110, tertiary sprocket 112, and secondary chain 114 form a power transmission assembly configured to transmit power from the motor 102 to the drive plate 116. Other embodiments include additional shafts, sprockets, hubs, chains, and/or plates as part of a power transmission assembly. Other embodiments omit one or more of the illustrated components of the power transmission assembly. For example, some embodiments include a single roller chain coupling a sprocket positioned on a shaft of a motor to a drive plate. In some embodiments, a secondary chain 114 is coupled to a drive plate 116 with a drive tab 134, as shown.

A series of shafts, chains, and sprockets that form the power transmission assembly are configured to adjust the rotary power of the motor to suit a user's needs and preferences, such as by configuring the chain and sprocket system for speed and torque conversion of the rotary power of the motor (e.g., by gearing up or gearing down the motor).

Other power transmission components are also used in the power transmission assembly, in accordance with other embodiments, to move the control lever of an ammunition system press. For example, the power transmission assembly includes one or more belts, pulleys, gears, tracks, rollers, racks (e.g., gear racks), worm gears, worms, clutches, universal joints, bearings, gear boxes, drive shafts, gear trains, right-angle drives, and/or other power transmission components known in the art, according to other embodiments, to convert power from the motor to the control lever of the ammunition system which controls movement of the ammunition system press.

Some alternative embodiments for transmitting power include a hydraulic assembly configured to hydraulically transmit power to the control lever, rather than using the motor and transmission components. The hydraulic assembly may use one or more hoses, fluids (e.g., hydraulic oils), valves, pumps, and the like, to move or otherwise manipulate a piston and/or the control lever connected to the drive plate and/or control lever. Some embodiments alternatively or additionally include a pneumatic assembly configured to pneumatically transmit power using one or more compressors, hoses, regulators, valves, and the like.

The motor 102 may be any type of motor suitable to a user based on torque, speed, power, and the like, and/or according to a user's other needs and preferences. For example, the motor may be a DC motor, such as a shunt, series, compounded, brushless, or permanent magnet motor, or the motor may be an AC motor such as an induction motor or a synchronous motor. The motor can also comprise a stepper type of motor or other specialized motor type.

The actuator assembly 100 includes a frame 120 configured to hold the various components of the actuator assembly in the appropriate spatial relationships relative to one another. The frame 120 also includes one or more mounting surfaces 122 configured to receive and/or secure a reloading press. As illustrated, the mounting surface 122 includes one or more holes 132 for bolting a reloading press into position on the mounting surface 122. In other embodiments, the frame 120 is attached to a reloading press by welding, clamping, chaining, pinning, riveting, and/or through the use of tie-downs, adhesives, and/or other suitable securing means.

As shown, the actuator assembly 100 includes a motor plate 124 configured to hold the motor 102 to the frame 120. The motor plate 124 can be held to the frame 120 with one or more bolts, pins, clamps or other adjustable fastener allowing the motor plate 124 to pivot and/or slide relative to the rest of the frame 120 (e.g., to enable tightening/loosening of one or more roller chains).

The actuator assembly 100 also includes a tab 126 and a tension bolt 128 allowing the motor plate 124 to be distanced from the drive plate 116 (e.g., to enable tightening/loosening of the secondary chain 114) by adjusting the position of the tension bolt 128 within its corresponding nut 130. Other embodiments may include other means for adjusting chain tension, as may be known in the art.

The actuator assembly 100 includes one or more coupling elements configured to join the actuator assembly 100 to a control segment (e.g., control lever) of a reloading press. For example, as in the illustrated embodiment, a U-bolt 136 may be positioned at the drive plate 116 so as to allow the control lever of the reloading press to be secured to the drive plate 116 by positioning the U-bolt 136 around the control lever 202 and through the drive plate 116.

Figure 4:
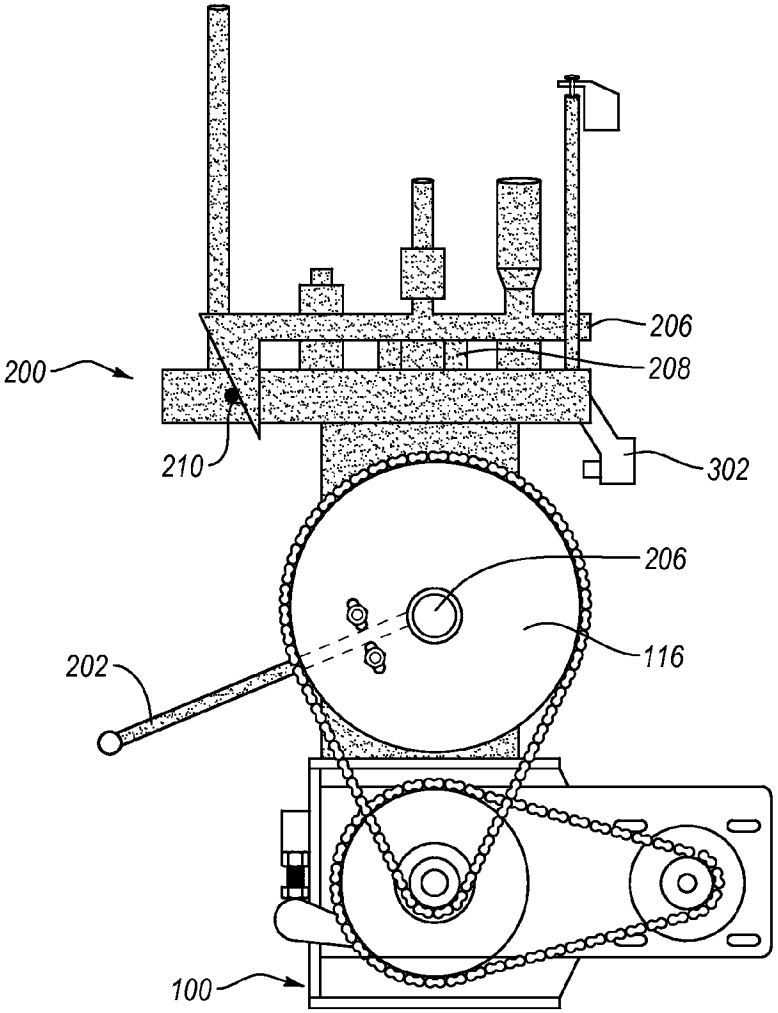
FIG. 4 illustrates the actuator assembly in operative relation with a reloading press of the ammunition reloading system, with a control lever of the reloading press in a down position.

FIG. 4 illustrates the actuator assembly 100 coupled to a reloading press 200. As shown, the drive plate 116 is positioned upon the reloading press shaft 206 and is fastened to the control lever 202, so as to place the control lever 202 in operative relation to the actuator assembly 100. In preferred embodiments, the drive plate 116 (or other terminal member of the actuator assembly 100) is coupled to the control lever 202 by one or more coupling elements. For example, as shown by the front-view illustration of FIG. 5, the drive plate 116 is configured to receive the free ends of one or more U-bolts 136, such that one or more U-bolts 136 are positioned and securable around the control lever 202 and through the drive plate 116 (where they may be fixedly secured by corresponding nuts, for example). Such a configuration allows the control lever 202 to be oscillated through an actuation distance through operation of the actuator assembly 100 (e.g., to rotate the reloading press shaft 206 of a reloading press, so as to operate the reloading press). In other embodiments, the actuator assembly 100 is attached to the control lever 202 via an adhesive, welding, clamping, friction fitting, pinning, and/or other fastening means.

In some embodiments, the drive plate 116 is additionally coupled to the reloading press 200 at the reloading press shaft 206. For example, the reloading press shaft 206 can include a set screw or bolt extending from the shaft 206 and configured in size and shape to pass through the center of the drive plate 116. A nut can mate with the set screw or bolt on the side of the drive plate 116 opposite the shaft 206, thereby tightening the drive plate 116 against or onto the shaft 206.

Figure 5:
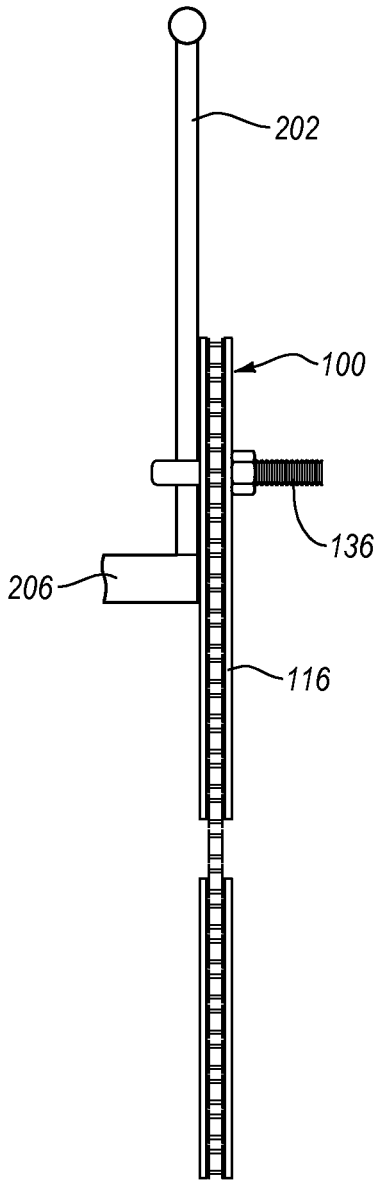
FIG. 5 illustrates a front-view of some of the actuator assembly components showing attachment of the actuator assembly to a control lever of the reloading press.
Figure 6:
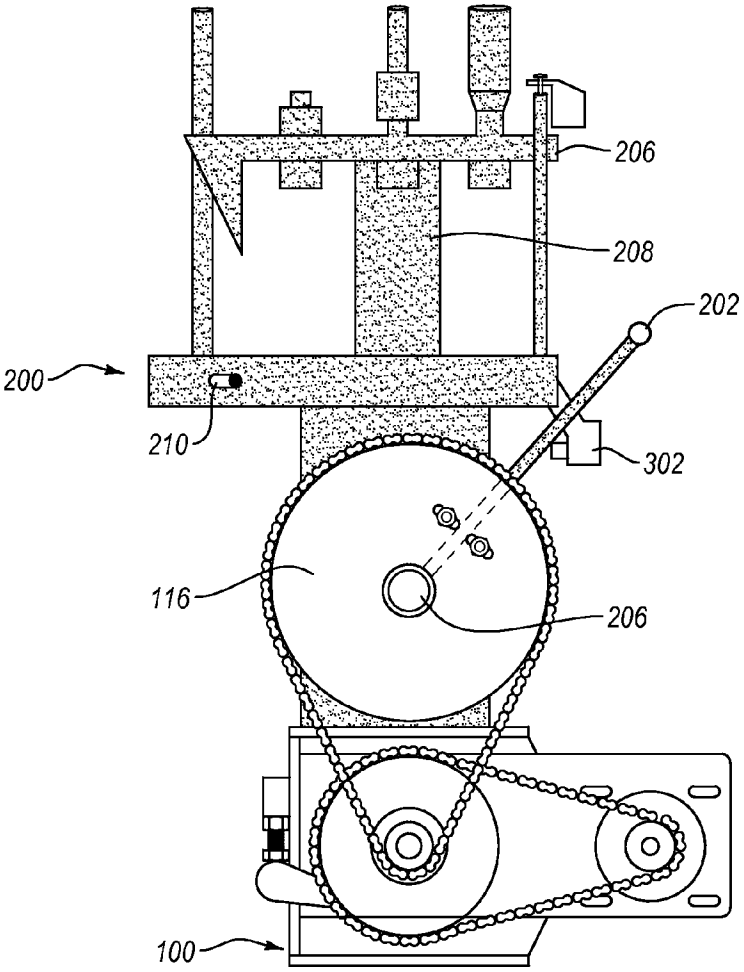
FIG. 6 illustrates the actuator assembly in operative relation with a reloading press, with a control lever of the reloading press in an open and up position.

As shown by FIG. 4, the control lever 202 may be moved to a down position (e.g., corresponding to a closed position of the reloading press 200) while connected to the actuator assembly 100, corresponding to radial movement of the drive plate 116. FIGS. 5 and 6 illustrate the control lever 202 moved to an up position (e.g., corresponding to an open position of the reloading press 200) while connected to the actuator assembly drive plate 116. FIG. 6 also illustrates a control lever position sensor 302 disposed so as to contact the control lever 202 when the control lever 202 and reloading press 200 is brought substantially to the extremity of the up position.

For example, the reloading press 200 is configured in such embodiments to be moved from a down configuration (as in FIG. 4) to an up configuration (as in FIG. 6) upon moving the control lever 202 from a down position to an up position. Actuation of the control lever 202 causes a corresponding raising/lowering of column 208, thereby moving the translating portion 212 of the reloading press accordingly. The illustrated embodiment also includes a sliding pin 210 configured to be moved upon raising and lowering of the translating portion 212. In one embodiment, movement of the sliding pin 210 causes actuation of one or more of the reloading press components 204 (e.g., actuation of a case downtube to move the next case into the press), rotation of a shell plate to move cases to their next respective positions within the press, and/or unloading of a finished case from the press, for example.

In the illustrated embodiment, the reloading press 200 includes a translating portion 212 positioned above a stationary portion, with the translating portion 212 configured to move down to place the reloading press 200 in a closed configuration and to move up to place the reloading press 200 in an open configuration. In an alternative embodiment, the translating portion is positioned below the stationary portion, with the translating portion configured to move up to place the reloading press in a closed configuration and to move down to move the reloading press in an open position.

In some embodiments, the control lever 202 may be positioned in the down position (e.g., by a user manually moving the control lever 202). The actuator assembly 100 may then be operated so as to move the control lever 202 from the down position to the up position. In some embodiments, a control system (such as control system 300 shown in FIG. 1) can initiate and control operation of the actuator assembly 100 until the control lever 202 is moved from the down position to a position contacting the control lever 202 to the control lever position sensor 302. The control system can thereby determine an actuation distance of the control lever 202 as the distance the control lever 202 must be moved to deliver a full stroke of the reloading press 200. For example, the control system can determine the amount of rotation the shaft of the motor controlled by the control system must provide to the actuator assembly 100 in order to move the control lever 202 through the actuation distance. The control system may then control continuous oscillation of the control lever 202 through the actuation distance, thereby continuously operating the reloading press 200.

In other embodiments, movement of the control lever 202 in order to determine an actuation distance may be reversed. For example, the control lever 202 may first be moved to an up position, and then actuated to a down position, where a control lever position sensor can be positioned at or near an extremity down position of the control lever 202. In some embodiments, one or more control lever position sensors may be disposed at other locations throughout an actuation distance of the control lever, such as at or near each extremity position (e.g., up extremity position and down extremity position) and/or at other positions between extremity positions.

As the control lever 202 is moved (e.g., oscillated), ammunition loading/reloading processes are performed by the ammunition devices connected to the control lever. In some embodiments, the control lever belongs to an existing ammunition loader or reloader in the industry. For example, in one embodiment, the actuation assemblies and components (e.g., control systems), described herein, are mechanically and operably coupled to a reloading press sold under the trade name Dillon Precision Super 1050. In other embodiments, the actuation assemblies and components, described herein, are mechanically and operably coupled to other ammunition presses, such as progressive reloading presses sold under the trade names Dillon Precision XL 650, Lee Pro 1000, Lee Load Master, Hornady Lock-n-Load, Mec 8567N Grabber, Mec 9000E, Mec 9001E, and the like. Other ammunition loaders and reloading presses can also be configured with and/or be coupled to the actuation assemblies and other components (e.g., control systems) described herein.

Figure 7:
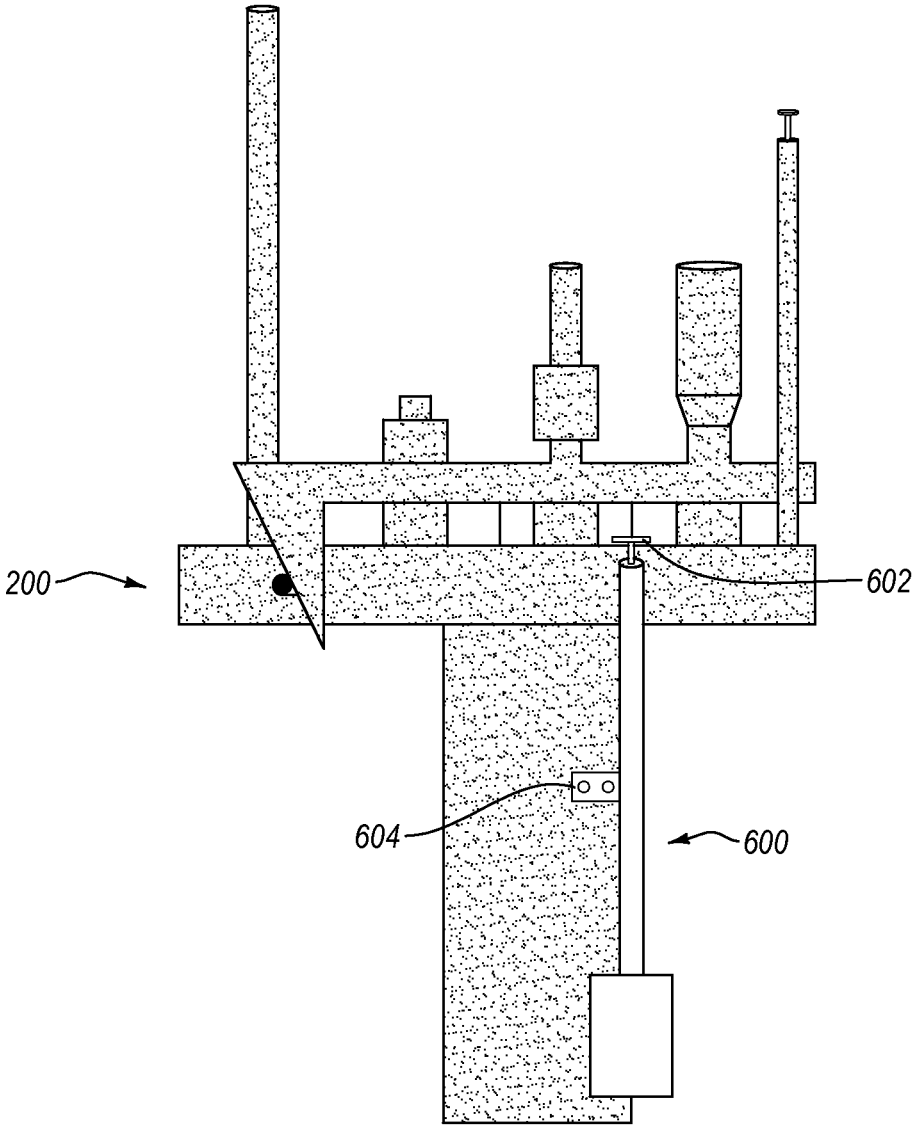
FIGS. 7-9 illustrate an embodiment of a case removal attachment configured to remove a case from a shell plate of a reloading press upon detection of a case defect.
Figure 8:
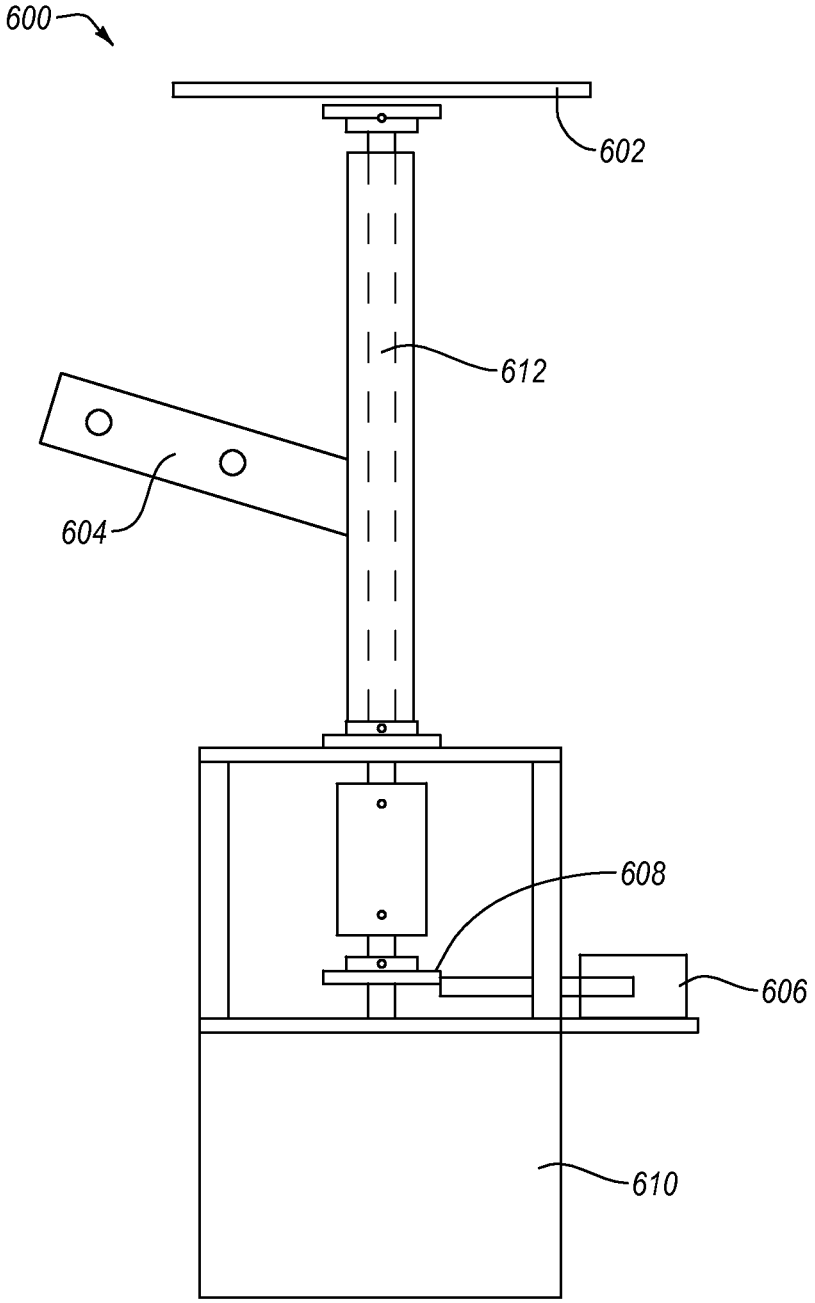
Figure 9:
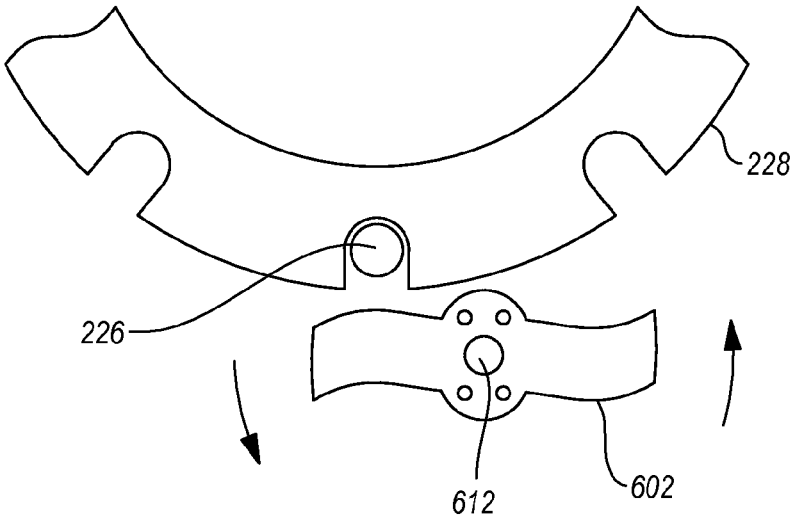

FIGS. 7-9 illustrate an embodiment of a case removal attachment configured to remove a case from a shell plate of a reloading press upon the detection of a case defect. As shown in FIG. 7, a case removal attachment 600 is attached to a reloading press 200 by a bracket 604. Alternatively, the case removal attachment 600 is attached to the reloading press 200 by one or more clamps, bolts, clasps, ties, other fasteners, welding, and/or adhesives. As described in further detail below, the case removal attachment 600 is positioned relative to the reloading press 200 such that a case contactor 602 of the case removal attachment 600 is able to engage with and dislodge a defective case from a shell plate (not shown in this view) of the reloading press 200 upon actuation of the case contactor 602. In some embodiments, the case removal attachment 600 is configured to dislodge a case upon user selection (e.g., via a user-selectable control at the control system). Additionally, or alternatively, the case removal attachment 600 is configured to dislodge a case upon the detection of a defective case (e.g., upon one or more sensors detecting the addition of a mis-sized primer, incorrect amount of powder, and/or other malfunctions or defects as described herein).

FIG. 8 illustrates a detailed view of the case removal attachment 600. As shown, the case removal attachment 600 includes a bracket 604 and/or other fastening means for attaching to a reloading press. The case removal attachment 600 includes a motor 610 configured to power the case contactor 602. The case contactor 602 is mechanically linked to the motor 610 by a shaft 612. In other embodiments, a case contactor may be mechanically coupled to a motor or other power source via one or more gears, belts, hydraulic assemblies, pneumatic assemblies, chain and sprocket assemblies, or other power transmission means known in the art. In the illustrated embodiment, upon actuation, the motor 610 rotates the shaft 612, and the shaft 612 is mechanically linked to the case contactor 602 so as to rotate the case contactor 602.

In the illustrated embodiment, the case removal attachment 600 includes a position switch 606 configured to control the position and/or orientation of the case contactor 602 relative to the reloading press. For example, when the case contactor 602 is in a home position (e.g., a position not obstructing the progression of cases through the reloading press), a cam 608 is in contact with the position switch 606. Upon actuation of the case removal attachment 600 (e.g., in response to the detection of a defective case, as described above), the motor 610 drives the rotation of the shaft 608 and case contactor 602, rotating the cam 608 out of contact with the position switch 606 as the case contactor 602 rotates to engage with and dislodge the defective case. In some embodiments, the motor 610 is configured to rotate until the cam 608 rotates back into contact with the position switch 606. In this manner, the case contactor 602 is able to rotate through a distance sufficient to dislodge the defective case (e.g., 180 degrees, 360 degrees) and return to the home position where it will not interfere with further operation of the reloading press.

FIG. 9 illustrates a top view of the case contactor 602 attached to the shaft 612. As shown, the case removal attachment is positioned relative to the reloading press so as to position the case contactor 602 near the shell plate 228. As the reloading press is operated, the shell plate 228 rotates to progressively move case 226 through the reloading process (e.g., the case 226 moves forward one position per stroke of the control lever of the reloading press). As shown, the case contactor 602 is oriented in a home position that allows the shell plate 228 to rotate without case contactor 602 coming into contact with case 226. Upon actuation, the case contactor 602 rotates to engage with and dislodge case 226 from the shell plate 228 (e.g., rotates 180 degrees before a position switch terminates further rotation, as described above).

Embodiments of case removal attachments described herein can provide a number of benefits. For example, a reloading press coupled to an actuation assembly that detects a defective case (e.g., through one or more sensors as described herein), can allow the case removal attachment to remove the defective case during automated operation of the reloading press, or with minimal downtime of automatic operation of the reloading press, without the need for manual intervention. In addition, such embodiments can enable an automated reloading process to continue with no or minimal downtime and can reduce or prevent the occurrence of further processing of defective cases, which could otherwise result in higher rates of machine wear, machine damage, and/or safety issues with the reloading press and/or reloaded ammunition.

Figure 10:
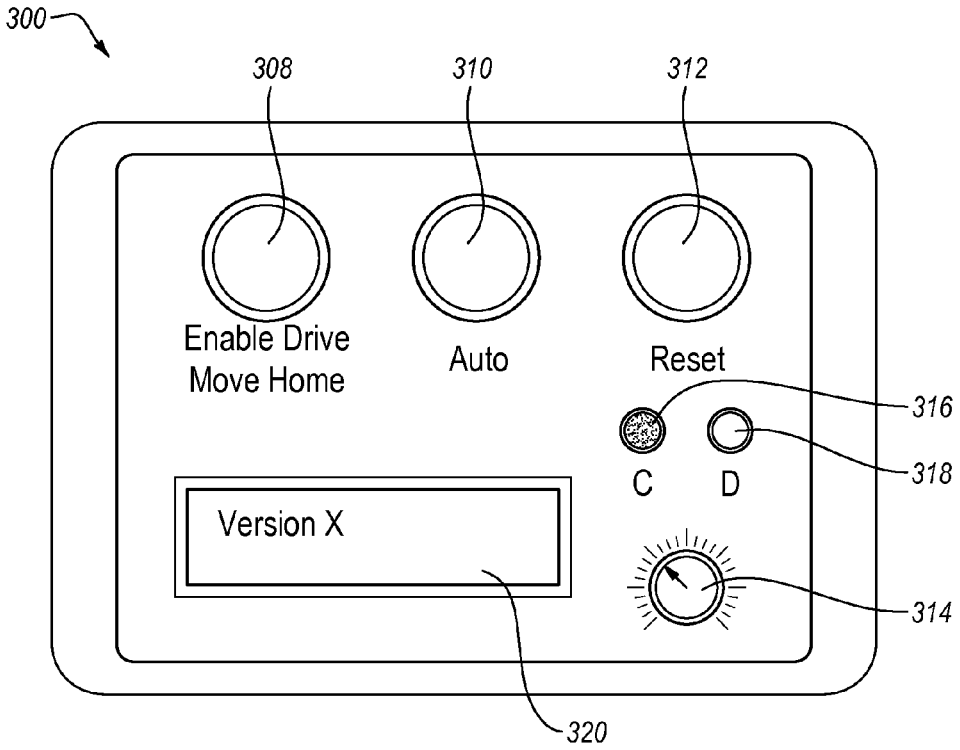
FIGS. 10-13 illustrate interfaces of a control system in communication with an actuator assembly.

FIGS. 10-13 illustrate embodiments of interfaces of the control system 300. As shown in FIG. 10, the control system 300 includes one or more interfaces having one or more controls, indicators, and/or displays. For example, as illustrated, the interface in FIG. 10 includes a home position control 308, an automatic operation control 310, a reset 312, a speed adjustment 314, a power indicator light 316, a drive indicator light 318, and a display screen 320.

In some embodiments, the home position control 308, upon user selection, enables operation of the actuator assembly so as to bring the control lever from the down position toward the up position (or vice versa) until the control lever reaches an extremity position (e.g., as detected by one or more control lever position sensors). For example, the interface of FIG. 10 shows the power indicator light 316 as on, but the drive indicator light 318 as off, indicating to a user that the control system 300 has power, but that the actuator assembly is not yet configured for operation. A user may then position the control lever of the attached reloading press to an extremity position, and may then press the home position control 308 to operate the actuator assembly and move the control lever toward the opposite extremity position in order to determine the actuation distance of the control lever.

Figure 11:
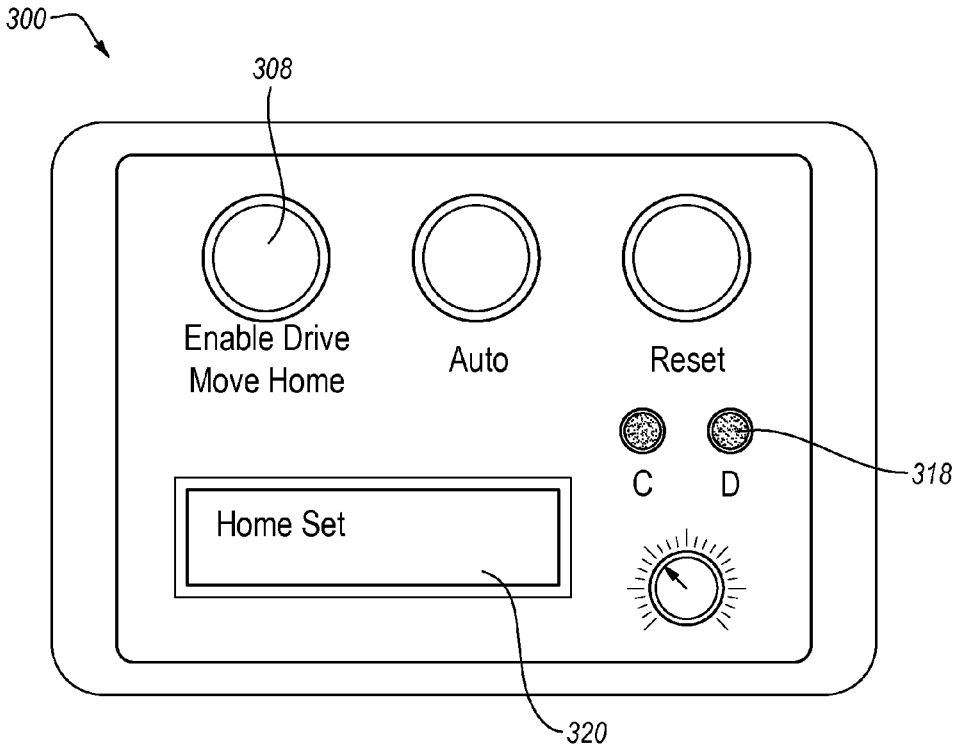

FIG. 11 illustrates an interface of the control system 300 after selection of the home position control 308 and determination of the actuation distance. As shown in FIG. 11, the display screen 320 can display "Home Set" (or "Ready" or the like) indicating to the user that the control system 300 has determined the actuation distance. Additionally, or alternatively, the drive indicator light 318 may light up to indicate that the system has been prepared for operation.

Figure 12:
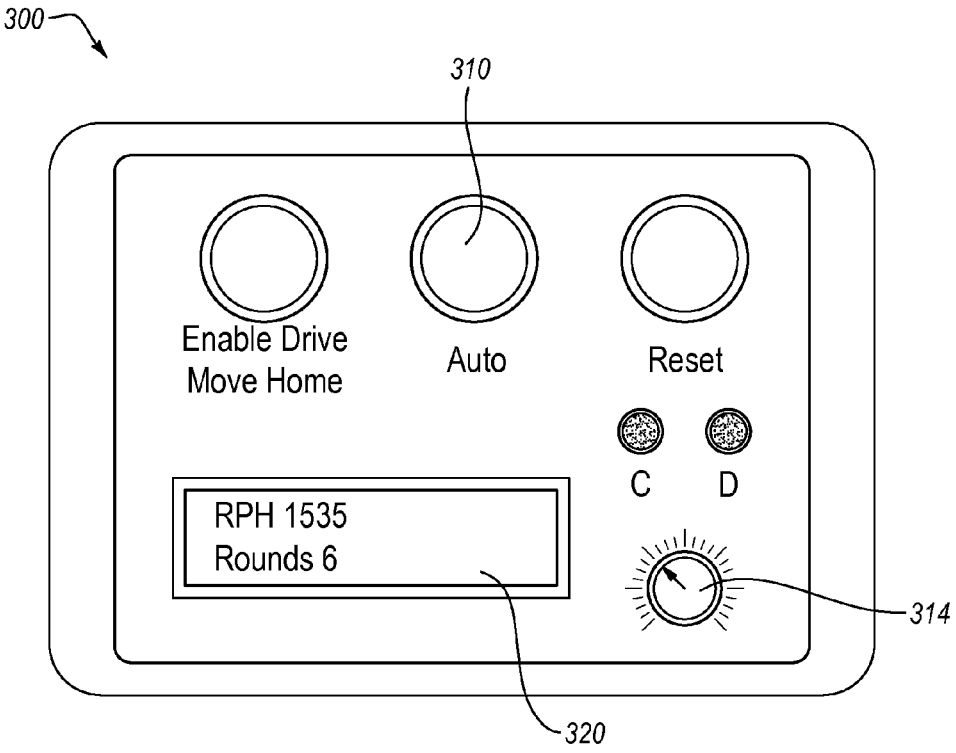

The automatic operation control 310 is selectable to cause operation of the ammunition reloading system, in some embodiments. FIG. 12 illustrates an embodiment of an interface of the control system upon selection of the automatic operation control 310. After selection, the control system 300 controls the actuator assembly (e.g., by controlling the rotation of a motor of the actuator assembly) so as to oscillate the attached control lever through the actuation distance, so as to automatically operate the reloading press. As shown in FIG. 12, the display screen 320 may display operational information about the automatic reloading process, such as a round production rate (i.e., rounds per hour or RPH), and a round count (e.g., number of strokes completed since initiation of automatic operation and/or since last resetting of the control system 300).

The speed adjustment 314 may be a dial, slide, button combination, or other user selectable control that is configured to, upon manipulation by a user, adjust the oscillation frequency of the actuator assembly (thereby adjusting the oscillation frequency of the control lever and reloading press, when connected). The control system 300 is configured to provide a plurality of selectable round production rates within predetermined ranges, such as from about 360 to about 5400 RPH, about 720 to about 3600 RPH, or about 1200 to about 1800 RPH.

Figure 13:
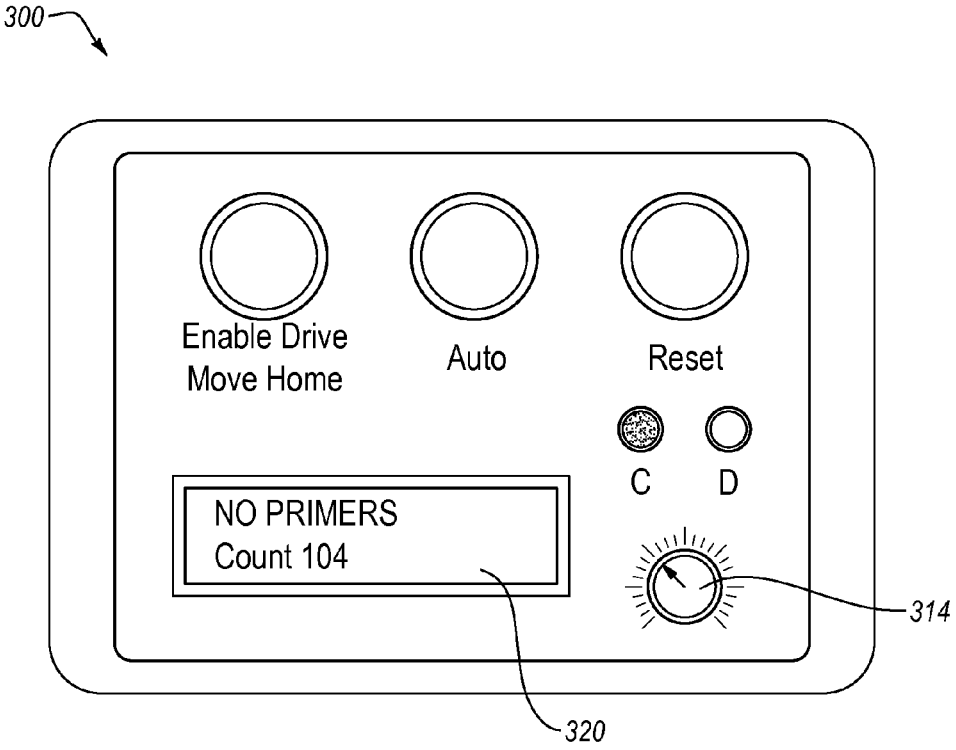

FIG. 13 illustrates an embodiment of an interface of the control system 300 after the control system 300 has detected a malfunction. For example, upon detecting an absence of primers (e.g., through a reloading component sensor 304 as shown in FIG. 1), the control system 300 can automatically terminate operation of the actuator assembly and can display "No Primers" or the like on the display screen 320. As shown, the display screen 320 can continue to show a round count indicating the number of rounds completed prior to interruption. Additionally, or alternatively, other embodiments may utilize one or more component sensors to detect the absence of, or low levels of, bullets, cases, powder, and/or other reloading components. The control system 300 can, for example, automatically terminate operation of the actuator assembly and can display "No Bullets," "No Cases," "Low Powder," and the like. In another example, a reloading system includes a primer size sensor configured to detect the presence or passage of a mis-sized primer for a given application (e.g., primers too small for a 0.45 ACP cartridge reloading application). Upon detection of a small primer, the control system 300 automatically terminates operation of the actuator assembly and generates a display of "Small Primer" or the like, allowing a user to remove the small primer prior to further reloading.

Figure 14:
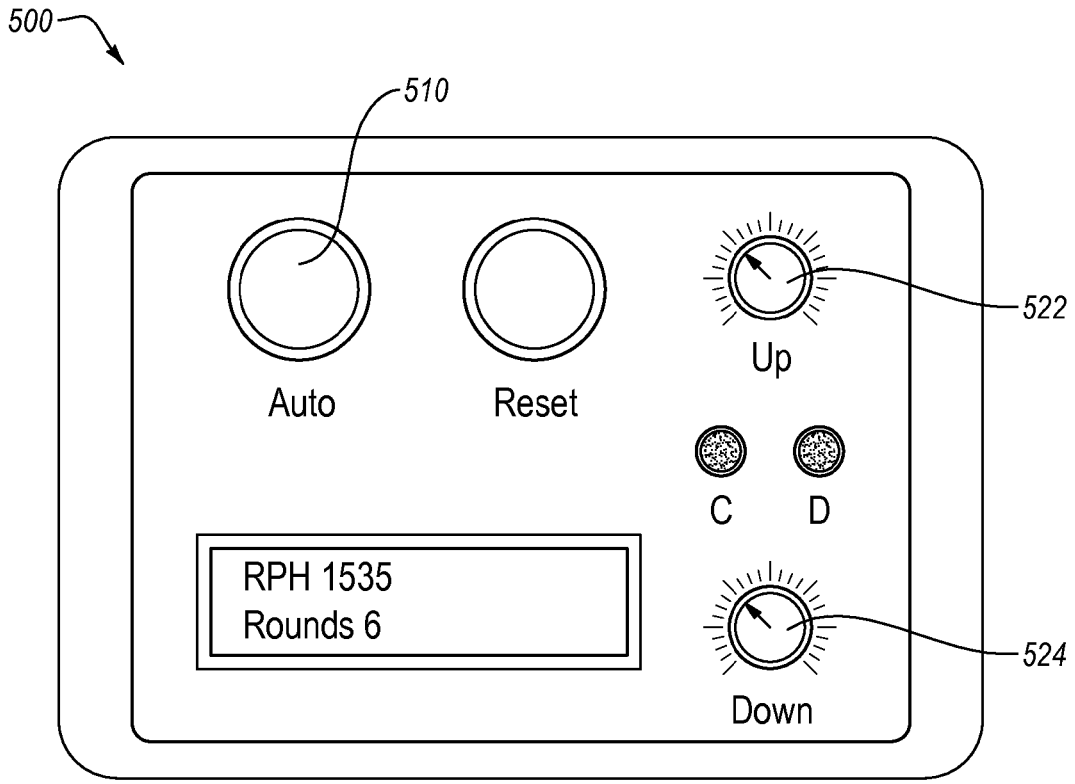
FIG. 14 illustrates an interface of a control system in communication with an actuator assembly having a variable up-stroke speed and a variable down-stroke speed.

FIG. 14 illustrates another embodiment of an interface of a control system 500 which receives the sensor input to determine a position of the control lever and presence of loading/reloading components, as described above. In this embodiment, the control system 500 omits a home position control. In this embodiment, for example, a control lever of a reloading press is moved to a position opposite a control lever position sensor (e.g., the control lever can be moved to a down extremity position and a control lever position sensor can be disposed at an up extremity position), and a user can begin an automated reloading process by selecting the automatic operation control 510, without the need to select a home position control first.

The illustrated embodiment also includes dual speed control functionality. The control system 500 includes an up speed control 522 and a separate down speed control 524. The up speed control 522 is configured to selectively control the actuation speed of the actuator assembly during the upward portion of a control lever stroke (e.g., as the control lever moves from a downward extremity position to an upward extremity position). For instance, the up speed control 522 can be rotated or otherwise manipulated to controllably adjust the speed of the actuator motor during the upstroke of the control lever (e.g., by controlling an amount of power allowed to pass to the motor through the control box during the up stroke, adjusting a step frequency of a stepper motor, by changing the duty cycle of a pulse width modulated power source, by varying the current and/or voltage directed to the motor, varying the frequency of the power source applied to the motor, and/or by otherwise controlling drive power directed to the motor).

Similarly, the down speed control 524 is configured to control the actuation speed of the actuator assembly, by adjusting the speed of the actuator motor, during the downward portion of a control lever stroke (e.g., as the control lever moves from an upward extremity position to a downward extremity position). For instance, the down speed control 524 can be rotated or otherwise manipulated to controllably adjust the speed of the actuator motor during the down stroke of the control lever (e.g., by controlling an amount of power allowed to pass to the motor through the control box during the up stroke, adjusting a step frequency of a stepper motor, by changing the duty cycle of a pulse width modulated power source, by varying the current and/or voltage directed to the motor, varying the frequency of the power source applied to the motor, and/or by otherwise controlling drive power directed to the motor).

Separation of speed control to enable asynchronous actuation speed during separate portions of a stroke cycle can provide a number of benefits. For example, speed can be lowered during the down stroke to enable the motor to provide greater torque to the press, while speed can be increased during the up stroke when there is less power demand. This type of speed configuration can provide the necessary press closing power for a given process while maintaining high overall round production rates. In another example, speed can be lowered during the up stroke in order to allow time for sufficient powder to be introduced to a case, while speed during the down stroke is held relatively higher to increase the overall round production rate.

Embodiments of ammunition reloading systems described herein may provide a number of benefits. For example, one or more embodiments can be configured to be added to an existing reloading press in a simple fashion requiring minimal or no modification to the reloading press. For example, the actuator system of some embodiments of the present invention may simply be bolted on to a reloading press (e.g., by bolting the reloading press to the frame of the actuator assembly and coupling the actuator assembly to the control lever of the reloading press, as described above). The advantages and benefits of the present invention therefore provide for an easily adaptable upgrade to an existing reloading press system. This can beneficially leave the stroke length of the reloading press unmodified, maintaining the ability to use the reloading press for longer and/or larger rounds (e.g., certain rifle rounds) that would otherwise no longer fit within the reloading press upon modification of the stroke length of the press.

In addition, one or more embodiments described herein can beneficially operate a reloading press by oscillating a control lever of the reloading press. This can provide for greater control and accuracy in a reloading operation. For example, the control lever can be continuously moved between opposing extremity positions and/or can be stopped or pulled back (e.g., the stroke length can be cut short) upon detection of an error or malfunction. Further, attachment to a control lever of the reloading press preserves the ability for manual operation and/or adjustment of the reloading press without the necessity of detaching the actuator assembly and/or undoing the modifications of the reloading press.

The terms "approximately," "about," and "substantially" as used herein represent an amount or condition close to the stated amount or condition that still performs a desired function or achieves a desired result. For example, the terms "approximately," "about," and "substantially" may refer to an amount or condition that deviates by less than 10%, or by less than 5%, or by less than 1%, or by less than 0.1%, or by less than 0.01% from a stated amount or condition.

In addition, unless expressly described otherwise, all stated amounts (e.g., angle measurements, dimension measurements, etc.) are to be interpreted as being "approximately," "about," and/or "substantially" the stated amount, regardless of whether the terms "approximately," "about," and/or "substantially" are expressly stated in relation to the stated amount(s).

Further, elements described in relation to any embodiment depicted and/or described herein may be combinable with elements described in relation to any other embodiment depicted and/or described herein. For example, any element described in relation to an embodiment depicted in FIGS. 1 through 3 may be combinable with an embodiment described in relation to an embodiment depicted in FIGS. 4 through 10.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An ammunition reloading system, comprising:

a motor;

a frame configured to be attachable to an ammunition reloading press;

a power transmission assembly joined to the motor and to the frame, the power transmission assembly including at least three sprockets mechanically coupled by at least two roller chains, and a coupling element configured to couple with a control lever of the ammunition reloading press, the power transmission assembly being configured to transmit power from the motor to the control lever so as to actuate the ammunition reloading press; and a control system in operative communication with the motor and with one or more sensors, the control system being configured to receive input from the one or more sensors, the input including a first extremity position of the control lever, and to send one or more operational instructions to the motor based on the received input.

2. The ammunition reloading system of claim 1, wherein the power transmission assembly includes a primary shaft extending from the motor and coupled to a primary sprocket, a secondary shaft coupled to a secondary sprocket, a primary chain positioned on the primary sprocket and the secondary sprocket and mechanically coupling the primary shaft to the secondary shaft, a tertiary sprocket coupled to the secondary shaft, and a secondary chain positioned on the tertiary sprocket and a drive plate and mechanically coupling the secondary shaft to the drive plate.

3. The ammunition reloading system of claim 1, wherein the coupling element is a U-bolt.

4. The ammunition reloading system of claim 3, wherein the power transmission assembly includes a drive plate, and wherein the U-bolt includes a curved portion and two free ends, the curved portion of the U-bolt being positioned around the control lever and the free ends of the U-bolt extending through the drive plate to secure the control lever in position relative to the drive plate.

5. The ammunition reloading system of claim 1, wherein the power transmission assembly includes a drive plate, the drive plate being joined to the coupling element and being configured to transmit power to the control segment through oscillatory rotation.

6. The ammunition reloading system of claim 1, wherein the one or more sensors include a control lever sensor configured to detect the first extremity position of the control lever, and wherein the control system is configured to compare a distance between a second extremity position of the control lever and the first extremity position of the control lever to determine an actuation distance between the first extremity position and the second extremity position.

7. The ammunition reloading system of claim 6, wherein the control system is configured to selectively operate the motor so as to enable oscillatory actuation of the control lever through the actuation distance.

8. The ammunition reloading system of claim 6, wherein the control system is configured to send a shut-down instruction to the motor upon detecting that the control lever was not passed through the actuation distance.

9. The ammunition reloading system of claim 1, wherein the control system includes a user-selectable control configured to instruct the motor to move the control lever until the control system detects a first extremity position of the control lever.

10. The ammunition reloading system of claim 1, wherein the control system includes a user-selectable speed control configured to adjust the speed of control lever actuation.

11. The ammunition reloading system of claim 1, wherein the control system includes a first user-selectable speed control and a second user-selectable speed control, the first user-selectable speed control being configured to adjust the speed of control lever actuation through a first portion of a control lever stroke, and the second user-selectable speed control being configured to adjust the speed of control lever actuation through a second portion of the control lever stroke.

12. The ammunition reloading system of claim 1, wherein the control system includes an information display configured to display one or more of a round count and a round production rate.

13. The ammunition reloading system of claim 1, further comprising a hand-held switch detached from the control system and in communication with the control system, the hand-held switch being configured to send a shut-down instruction to the control system upon actuation.

14. A method of automated reloading of ammunition, comprising:

positioning a control lever of an ammunition reloading press at a first extremity position, the ammunition reloading press being coupled to an ammunition reloading system including:

a motor;

a frame attached to the ammunition reloading press;

a power transmission assembly joined to the motor and to the frame, the power transmission assembly including at least three sprockets mechanically coupled to at least two roller chains, and a coupling element configured to couple with the control lever, the power transmission assembly being configured to transmit power from the motor to the control lever so as to actuate the ammunition reloading press; and a control system in operative communication with the motor and with one or more sensors, the control system being configured to receive input from the one or more sensors and to send one or more operational instructions to the motor based on the received input;

actuating the control lever to move the control lever from the first extremity position to a second extremity position, the distance between the first extremity position and the second extremity position defining an actuation distance; and operating the ammunition reloading system to provide oscillatory actuation of the control lever through the actuation distance.

15. The method of claim 14, wherein the second extremity position is detected by a control lever sensor.

16. The method of claim 14, further comprising terminating oscillatory actuation of the control lever upon the control system receiving termination input from the one or more sensors.

* * * * *